US011466421B2

(12) United States Patent
Powell et al.

(10) Patent No.: US 11,466,421 B2
(45) Date of Patent: Oct. 11, 2022

(54) HORIZONTALLY EXTENDABLE SILT FENCE

(71) Applicant: New Pig Corporation, Tipton, PA (US)

(72) Inventors: Beth P. Powell, State College, PA (US); Matthew J Huff, Tyrone, PA (US); Joshua P. Albright, Altoona, PA (US)

(73) Assignee: New Pig Corporation, Tipton, PA (US)

( * ) Notice: Subject to any disclaimer, the term of this patent is extended or adjusted under 35 U.S.C. 154(b) by 4 days.

(21) Appl. No.: 17/118,896

(22) Filed: Dec. 11, 2020

(65) Prior Publication Data

US 2021/0180281 A1 Jun. 17, 2021

Related U.S. Application Data

(60) Provisional application No. 62/946,487, filed on Dec. 11, 2019, provisional application No. 62/994,374, filed on Mar. 25, 2020.

(51) Int. Cl.

| | |
|---|---|
| ***E02D 17/20*** | (2006.01) |
| ***E01F 7/02*** | (2006.01) |
| ***E01F 7/04*** | (2006.01) |
| ***E04H 17/20*** | (2006.01) |
| *E02D 5/80* | (2006.01) |

(52) U.S. Cl.

CPC ..... *E02D 17/202* (2013.01); *E01F 7/04* (2013.01); *E04H 17/20* (2013.01); *E02D 5/80* (2013.01); *E02D 2300/0085* (2013.01)

(58) Field of Classification Search

CPC ..... E02D 17/202; E02D 17/207; E02D 2300/0085; E02D 5/80; E04H 17/20

See application file for complete search history.

(56) References Cited

U.S. PATENT DOCUMENTS

| | | | |
|---|---|---|---|
| 2,593,408 | A | 4/1952 | Boardman |
| 2,633,172 | A | 3/1953 | Treiber |
| 2,730,150 | A | 1/1956 | Wunderwald et al. |
| 2,851,075 | A | 9/1958 | Palfey |
| 2,854,049 | A | 9/1958 | Wyllie |
| 2,915,097 | A | 12/1959 | Lewis |

(Continued)

FOREIGN PATENT DOCUMENTS

| | | |
|---|---|---|
| WO | 0181208 | 11/2001 |
| WO | 2016201332 | 12/2018 |

*Primary Examiner* — Benjamin F Fiorello
*Assistant Examiner* — Stacy N Lawson
(74) *Attorney, Agent, or Firm* — Charles M. Yeomans; Leech Tishman Fuscaldo & Lampl

(57) ABSTRACT

The present invention is directed to a horizontally extendable silt fence. The present invention is also directed to a silt fence system comprising a horizontally extendable silt fence comprising a water permeable geotextile material having an upper edge and a lower edge, and a plurality of posts comprising an upper portion strutted and arranged to be coupled with the upper edge of the water permeable geotextile material, a lower portion structured and arranged to be coupled with the lower edge of the water permeable geotextile material, and an anchor portion structured and arranged to be driven into the ground to anchor the post. Also disclosed is a method of filtering silt from a fluid stream.

16 Claims, 8 Drawing Sheets

(56) References Cited

U.S. PATENT DOCUMENTS

| | | | | |
|---|---|---|---|---|
| 2,987,299 | A * | 6/1961 | Kneen | E04H 17/06 256/32 |
| 4,124,049 | A | 11/1978 | Yamaguchi | |
| 4,657,433 | A * | 4/1987 | Holmberg | E02B 3/04 405/21 |
| 4,756,511 | A * | 7/1988 | Wright, III | E04H 17/10 256/12.5 |
| 4,787,774 | A | 11/1988 | Grove | |
| 2006/0133897 | A1 | 6/2006 | Douglas et al. | |
| 2006/0133900 | A1 | 6/2006 | Singleton | |
| 2007/0069191 | A1* | 3/2007 | Arnold | E01F 7/025 256/12.5 |
| 2007/0228349 | A1* | 10/2007 | Smith | E01F 13/028 160/122 |
| 2009/0257827 | A1* | 10/2009 | Wilson | E02D 17/20 405/21 |
| 2014/0154018 | A1 | 6/2014 | Singleton | |
| 2016/0362865 | A1* | 12/2016 | Segroves | E02D 17/202 |
| 2019/0352867 | A1 | 11/2019 | Schaaf | |

* cited by examiner

HORIZONTALLY EXTENDABLE SILT FENCE

CROSS-REFERENCE TO RELATED APPLICATIONS

This application claims the benefit of U.S. Provisional Patent Application Ser. No. 62/946,487, filed on Dec. 11, 2019, and U.S. Provisional Patent Application Ser. No. 62/994,374, filed on Mar. 25, 2020, each of which are incorporated herein by reference.

BACKGROUND OF THE INVENTION

Soil disturbances during construction can result in sediment washing into waterways (e.g. streams, lakes, ponds, wetlands) and roadways during rain events. The sediment in the rainwater reduces clarity in the runoff, which negatively affects sunlight reaching aquatic plants and animals, while sediment on roadways poses safety hazards for drivers and can clog storm drains. Sediment is the number one pollutant of U.S. water resources even though sediment control is commonly required to comply with NPDES (National Pollution Discharge Elimination System) regulations. Sediment control is installed before soil disturbance begins. One type of sediment control is sediment-retention devices (SRDs), which include silt fence, silt socks, wattles, filter logs, compost and earthen berms, and storm inlet protectors. SRDs retain the soil on disturbed land until revegetation and permanent soil stabilization begin without the large area required by settlement ponds.

Silt fences are a popular SRD because the materials are relatively inexpensive and can pool the rainwater up to 24" or more to allow the accumulated sediment to settle out while slowly filtering the rainwater. A single 100-foot run of silt fence can hold back 50 tons of sediment and water. A silt fence is composed of a permeable geotextile, such as woven, non-woven and mono-filament plastics, stretched between wooden or metal posts driven into the ground in regular intervals on the downhill side of the silt fence. The geotextile acts as a surface filter so the pores clog quickly to hold the rainwater back while the sediment settles out.

The bottom of the geotextile is trenched (e.g., 6" wide by 6"-8" deep on the uphill side) or static-sliced (e.g., 12" deep slit) into the ground to prevent rainwater from running underneath. Both trenching and static slicing are affected by roots and rocks below the ground surface as well as terrain contours or property liners. After trenching and static slicing, the ground over the buried geotextile must be compacted to prevent rainwater from infiltrating into the air spaces and eroding into channels underneath the silt fence leading to sediment washout. A wire or chain-link fence, also held up by the posts, can be placed behind the geotextile to help distribute the hydraulic force on individual posts and reduce the stretching of the geotextile as has it holds back water and accumulated sedimentation. The wire or chain-link fence may double the cost of the silt fence installation and entails disposing of more material in a landfill when removed.

Regardless of the installation method, proper attachment of the geotextile to the posts is critical to combine the strength of the geotextile and posts into a unified structure. Silt fence failure, such as falling over and infiltration, caused by poor installation techniques is the major issue with this SRD. The silt fence must be inspected routinely after runoff events.

Another popular SRD to achieve 24" of ponding is silt socks, which are tubes made of woven net fabric filled with compost, wood chips, or switch grass. The silt socks are held in place with wooden stakes driven through the top of the tube and into the around below. They filter the rainwater faster than silt fences due to larger pore size and depth filtration, which captures the sedimentation within the filler material instead of only on the surface. The issue with silt socks is that they are more expensive than silt fence. The compost and wood chip-filled versions are heavy to transport during installation and removal and weigh approximately 45 pounds per linear foot. The 24" diameter socks are filled at the construction location, requiring numerous truckloads of compost or a source of nearby wood-chips. If the landowner approves of the pile of compost being left behind, compost socks can be cut open when no longer needed so that only the net fabric is sent to the landfill. Wood-chip socks are acidic and inhibit revegetation when cut open. The wood chips either need to be removed or neutralized into the soil. Switch grass socks are lighter weight but are still bulky to transport and are more easily displaced by rainwater, leading to sediment-laden rainwater escaping underneath. Independent of the type of filler in the sock, loose compost is typically blown against the bottom of the flow side to reduce channeling of sediment-laden rainwater under the sock where it does not conform to the surface.

An SRD that is resistant to poor installation techniques compared to a traditional silt fence, and that is less expensive to transport, install and remove than a silt sock is desired.

SUMMARY OF THE INVENTION

The present invention is directed to a horizontally extendable silt fence comprising a water permeable geotextile material having an upper edge and a lower edge, and a stabilizer strap fastened at an upper location below the upper edge and a lower location at or above the lower edge to form a water retention pocket, wherein a width of the stabilizer strap $W_S$ measured from the upper location to the lower location of the water permeable geotextile material is less than a width of the water permeable geotextile material Wu measured from the upper location to the lower location.

The present invention is also directed to a silt fence system comprising a horizontally extendable silt fence comprising a water permeable geotextile material having an upper edge and a lower edge and a width measured from the upper edge to the lower edge; and a plurality of posts comprising an upper portion structured and arranged to be coupled with the upper edge of the water permeable geotextile material; a lower portion structured and arranged to be coupled with the lower edge of the water permeable geotextile material; and an anchor portion structured and arranged to be driven into the ground to anchor the post, wherein the horizontally extendable silt fence has a height measured from the coupling of the upper edge and lower edge of the water permeable geotextile material to the post, and a ratio W:H of a width of the geotextile of the water permeable geotextile material W to a height H of the horizontally extendable silt fence is at least 1.05:1.

The present invention is further directed towards a method of filtering silt from a fluid stream, the method comprising installing the silt fence system of the present invention in the path of the fluid stream with the horizontally extendable silt fence downhill from the posts.

DETAILED DESCRIPTION

Figure 1:
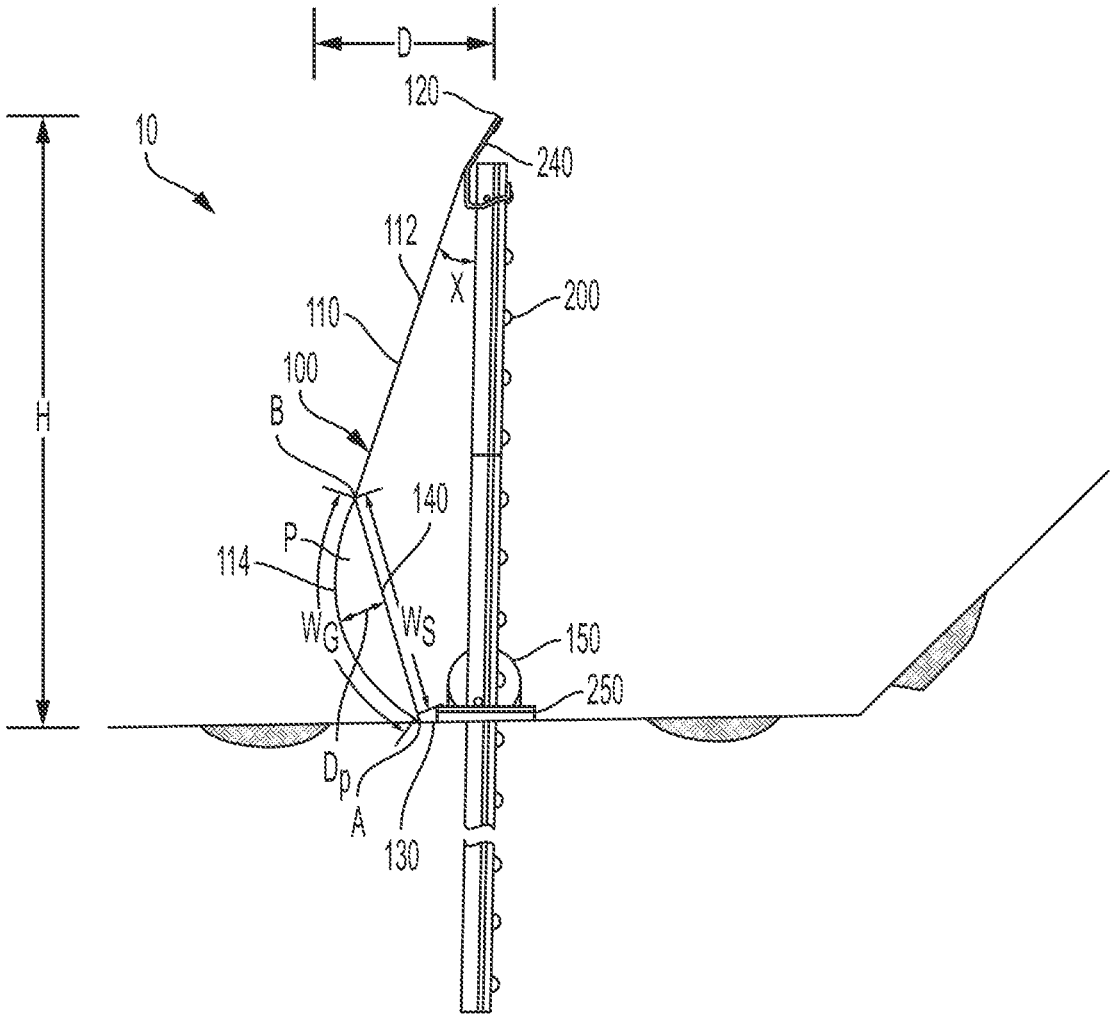
FIG. 1 is a side view of an exemplary silt fence system of the present invention.

The present invention is directed towards a horizontally extendable silt fence 100. The horizontally extendable silt fence 100 may be connected to a plurality of posts 200 to form a silt-fence system 10. Unlike traditional silt fences that rely on the posts to resist the hydraulic pressure pushing horizontally against the geotextile, the present invention when contacted by a fluid stream also utilizes a curved cross-sectional shape to horizontally extend and at least partially redirect hydraulic pressure. The curved shape may be described as concave or an onion shape, where the portion of the horizontally extendable silt fence 100 towards the bottom is larger than the top (decreasing radii), i.e., the bottom portion of the curve of the silt fence is further away from the supporting post than the top portion, as shown in FIG. 1. Accordingly, the horizontally extendable silt fence 100 may also be referred to as a curved or concave shaped silt fence. Because of the inwardly angled wall of the horizontally extendable silt fence, the contained liquid pushes down and up on the sidewall as well as horizontally. In addition, the water that collects over the portion of the horizontally extendable silt fence that contacts the ground may help to anchor the horizontally extendable silt fence in place due to the weight of the water. Although the curved shape of the horizontally extendable silt fence is self-supporting when full of collected water, it can roll on sloped surfaces. To distribute forces more evenly during filling and on sloped surfaces, a stabilizer strap 140 may optionally be included in the horizontally extendable silt fence 100. The silt fence system 10 of the present invention does not require trenching or static slicing followed by compaction for installation, and the silt fence system 10 is less prone to falling over.

The horizontally extendable silt fence 100 of the present invention comprises a water permeable geotextile material 110 having an upper edge 120, a lower edge 130, a generally planar upper section 112, and a concave lower section 114 as viewed from an upstream side of the silt fence. As used herein, the term "horizontally extendable silt fence" refers to a silt fence having a material that can be horizontally displaced away from the supporting post in the direction of the flow of the fluid passing through the silt fence to form a retention volume. The horizontally extendable silt fence 100 retains water within its retention volume past the posts 200 that secure the fence to the ground. For example, as shown in FIG. 1, the horizontally extendable silt fence 100 may be structured and arranged to be horizontally displaced a displacement distance "D" from the post 200 as fluid flows through the horizontally extendable silt fence 100 and subjects the horizontally extendable silt fence 100 to a hydrostatic force from the retained fluid. It will be understood that the figures showing the horizontally extendable silt fence 100 in an extended position such that the horizontally extendable silt fence 100 is horizontally displaced a distance D from the post show the horizontally extendable silt fence 100 subjected to hydrostatic force of a retained fluid, and that if no force is being applied to the horizontally extendable silt fence 100, the fence may drape loosely vertically before being extended when hydrostatic force of retained fluid displaces it. It will also be understood that the distance D may further extend and bulge as the horizontally extendable silt fence fills with sediment.

As shown in FIG. 1, the generally planar upper section 112 of the water permeable geotextile material 110 of the horizontally extendable silt fence 100 forms an acute angle "X" measured from the post 200 when the horizontally extendable silt fence 100 is horizontally displaced a distance D from the post by the hydrostatic force of retained fluid. The angle X may be at least 1°, such as at least 2°, such as at least 5°, such as at least 10°, such as at least 15°, such as at least 20°. The angle X may be no more than 45°, such as no more than 40°, such as no more than 35°, such as no more than 30°. The angle X may range from 1° to 45°, such as from 1° to 40°, such as from 1° to 35°, such as from 1° to 30°, such as from 2° to 45°, such as from 2° to 40°, such as from 2° to 35°, such as from 2° to 30°, such as from 5° to 45°, such as from 5° to 40°, such as from 5° to 35°, such as from 5° to 30°, such as from 10° to 45°, such as from 10° to 40°, such as from 10° to 35°, such as from 10° to 30°, such as from 15° to 45°, such as from 15° to 40°, such as from 15° to 35°, such as from 15° to 30°.

As shown in FIG. 1, the horizontally extendable silt fence 100 may optionally further comprise a stabilizer strap 140 fastened at an upper location (point B) below the upper edge 120 and a lower location (point A) at or above the lower edge 130 of the water permeable geotextile 110 material to form a water retention pocket P.

Figure 2:
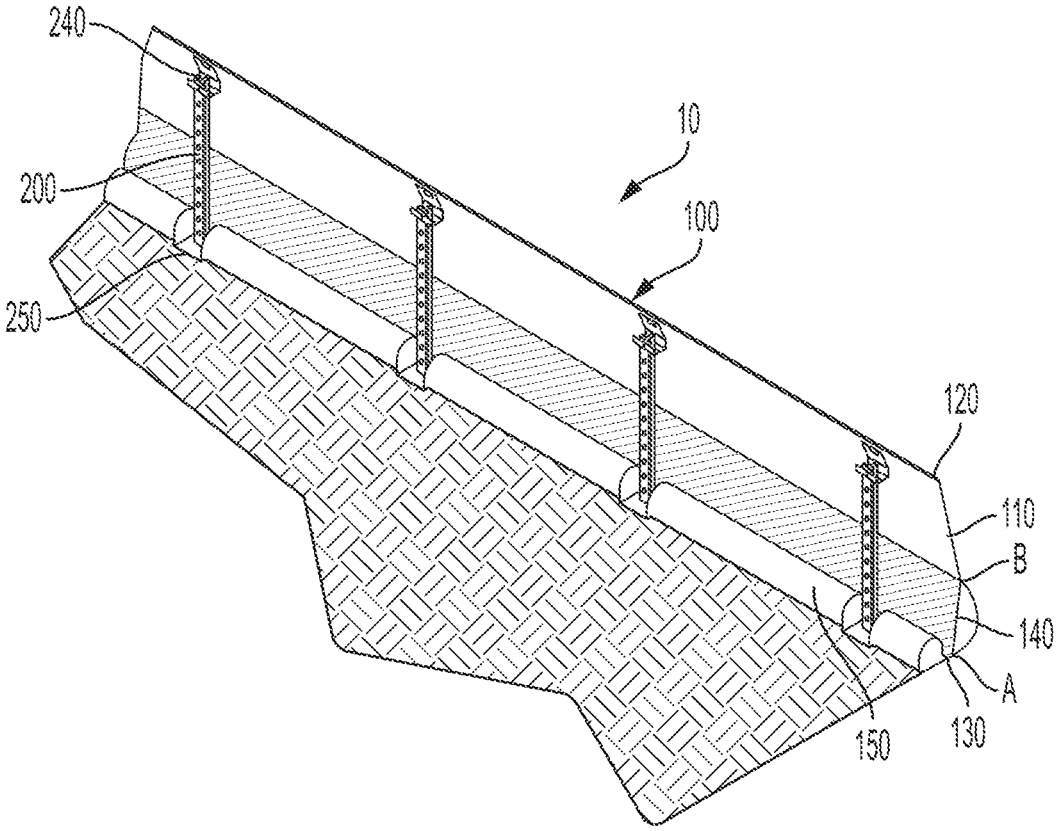
FIG. 2 is an isometric view of an exemplary silt fence system of the present invention.

As shown in FIG. 1, the width of the stabilizer strap 140, $W_s$, measured from the upper location (point B) to the lower location (point A) of the water permeable geotextile material 110, is less than the width of the water permeable geotextile material 110, $W_G$, measured from the upper location (point B) to the lower location (point A). The water retention pocket P may be empty, or at least partially or fully filled with a filler material such as, for example, sand, compost, wood chips, and/or switch grass, and may further include coagulants and/or flocculants in addition to or instead of the filler materials listed above. The stabilizer strap 140 may be continuous or discontinuous along the length of the water permeable geotextile material 110 of the silt fence 100. For example, as shown in FIG. 2, the stabilizer strap 140 may be a continuous panel that runs the length of the water permeable geotextile material 110 of the silt fence 100. The stabilizer strap 140 may comprise any suitable material. Non-limiting examples include a water permeable geotextile material that may be the same or different than that of the water permeable geotextile material 110, strip metal, nylon, or the like. In another example, the stabilizer strap 140 material may be a water permeable geotextile material that is more permeable to silt and sediment than the water permeable geotextile 110 such that the silt and sediment can pass through the stabilizer strap 140 and collect in the water retention pocket P. Alternatively, the stabilizer strap 140 material may be a water permeable geotextile material that is less permeable to silt and sediment than the water permeable geotextile 110. The stabilizer strap 140 is structured and arranged to retain the generally planar upper section 112 and concave lower section 114 (and curved or onion shape) of the water permeable geotextile material 110 when a fluid is passing through the silt fence by restricting the movement of the water permeable geotextile material 110. For example, as shown in FIG. 1, the stabilizer strap 140 is attached to the water permeable geotextile material 110 at points A and B. The weight of the water and sediment that collects in the horizontally extendable silt fence 100 prevents the portion of the lower edge 130 of the water permeable geotextile material 110 from lifting off the ground, and the downward force created by the weight of the water and sediment keeps the stabilizer strap 140 at point A on the ground and transmits that downward force to the water permeable geotextile material 110 at point B that helps to maintain the curved, concave or onion shape of the silt fence 100. The curved shape of the horizontally extendable silt fence 100 transfers a portion of the horizontal pressure of the water and sediment upward while the stabilizer strap 140 transfers a portion of the horizontal hydrostatic pressure to the bottom of the water permeable geotextile material 110.

As shown in FIG. 1, the distance $D_P$ between the water permeable geotextile material 110 and stabilizer strap 140 of the water retention pocket P may be at least 2 inches, such as at least 3 inches, such as at least 4 inches, such as at least 5 inches. The distance $D_P$ between the water permeable geotextile material 110 and stabilizer strap 140 of the water retention pocket P may be up to 36 inches or more, such as no more than 36 inches such as no more than 24 inches, such as no more than 12 inches, such as no more than 10 inches, such as no more than 8 inches, such as no more than 6 inches. The distance $D_P$ between the water permeable geotextile material 110 and stabilizer strap 140 of the water retention pocket P may be 2 to 36 inches, such as 2 to 24 inches, such as 2 to 12 inches, such as 2 to 10 inches, such as 2 to 8 inches, such as 2 to 6 inches, such as 3 to 36 inches, such as 3 to 24 inches, such as 3 to 12 inches, such as 3 to 10 inches, such as 3 to 8 inches, such as 3 to 6 inches, such as 4 to 36 inches, such as 4 to 24 inches, such as 4 to 12 inches, such as 4 to 10 inches, such as 4 to 8 inches, such as 4 to 6 inches, such as 5 to 36 inches, such as 5 to 24 inches, such as 5 to 12 inches, such as 5 to 10 inches, such as 5 to 8 inches, such as 5 to 6 inches. The distance $D_P$ refers to the furthest distance between the water permeable geotextile material and stabilizer strap.

As shown in FIG. 2, the stabilizer strap 140 may be in the form of a panel of textile that runs the length of the water permeable geotextile material 110. The material that forms the stabilizer strap 140 may also have breaks or openings along the length of the water permeable geotextile material 110 such that the stabilizer strap 140 is in the form of squares, rectangles or a strap of material that are positioned along the length of the water permeable geotextile material 110. The squares, rectangles or a strap may be uniformly or non-uniformly positioned along the length of the water permeable geotextile material 110. The stabilizer strap 140 may be constructed of a water permeable geotextile material having similar or dissimilar flow characteristics compared to the water permeable geotextile material 110 to act a pre-filter. The stabilizer strap 140 may also be in the form strips or wedge-shaped materials (e.g., textiles) instead of square or rectangular shaped panels. Combinations of these materials may also be used to form the stabilizer strap 140. Optionally, a gusset may be included to support the stabilizer strap 140.

As shown in FIG. 1 and FIG. 2, the stabilizer strap 140 forms an angle when a fluid is passing through the horizontally extendable silt fence 100 that displaces the silt fence into an extended position. The angle of the stabilizer strap 140 as fluid is passing through the horizontally extendable silt fence 100 may be from 95° to 135°, as measured with respect to the portion of the ground on the side of the stabilizer strap 140 closer to the lower edge 130 of the water permeable geotextile material 110 (e.g., from point A), such as an angle of 97° to 120°, such as an angle of 100° to 110°. The points of attachment (e.g., points A and B) of the stabilizer strap 140 to the water permeable geotextile material 110 should be selected such that the angle of the stabilizer strap 140 falls within these ranges.

The total width of the geotextile of the water permeable geotextile material 110 may be measured from the upper edge 120 to the lower edge 130 and is not particularly limited. For example, the water permeable geotextile material 110 may have a width of at least 16 inches, such as at least 25 inches, such as at least 30 inches. For example, the water permeable geotextile material 110 may have a width of no more than 68 inches, such as no more than 55 inches, such as no more than 37 inches, such as no more than 33 inches. For example, the water permeable geotextile material 110 may have a width of 16 to 68 inches, such as 25 to 68 inches, such as 40 to 68 inches, such as 16 to 55 inches, such as 25 to 55 inches, such as 40 to 55 inches, such as 16 to 37 inches, such as 25 to 37 inches, such as 30 to 37 inches, such as 16 to 33 inches, such as 25 to 33 inches, such as 30 to 33 inches.

The total width of the stabilizer strap 140 may be measured from the end to be attached to attachment point A to the end to be attached to attachment point B and is not particularly limited as long as the angle of the stabilizer strap 140 is within the ranges disclosed herein. For example, the stabilizer strap 140 may have a width of at least 4 inches, such as at least 6 inches, such as at least 8 inches. For example, the stabilizer strap 140 may have a width of no more than 16 inches, such as no more than 14 inches, such as no more than 12 inches. For example, the stabilizer strap 140 may have a width of 4 to 16 inches, such as 6 to 16 inches, such as 8 to 16 inches, such as 4 to 14 inches, such as 6 to 14 inches, such as 8 to 14 inches, such as 4 to 12 inches, such as 6 to 12 inches, such as 8 to 12 inches.

The end of the stabilizer strap 140 attached to attachment point A may have a distance from the lower edge 130 of the water permeable geotextile material 110 of 0 inches, such as at least 1 inch, such as at least 2 inches, such as at least 3 inches. The end of the stabilizer strap 140 attached to attachment point A may have a distance from the lower edge 130 of the water permeable geotextile material 110 of no more than 12 inches, such as no more than 6 inches, such as no more than 5 inches, such as no more than 3 inches. The end of the stabilizer strap 140 attached to attachment point A may have a distance from the lower edge 130 of the water permeable geotextile material 110 of 0 to 12 inches, such as 1 to 12 inches, such as 2 to 12 inches, such as 3 to 12 inches, such as 0 to 6 inches, such as 1 to 6 inches, such as 2 to 6 inches, such as 3 to 6 inches, such as 0 to 5 inches, such as 1 to 5 inches, such as 2 to 5 inches, such as 3 to 5 inches, such as 0 to 3 inches, such as 1 to 3 inches, such as 2 to 3 inches.

The ratio $W_G$:$W_S$ of the width of the water permeable geotextile material 110 $W_G$ to width of the stabilizer strap 140 $W_S$ may be at least 1.1:1, such as at least 1.2:1, such as at least 1.3:1, such as at least 1.4:1, such as at least 1.5:1. The ratio $W_G$:$W_S$ of the width of the water permeable geotextile material 110 $W_G$ to width of the stabilizer strap 140 $W_S$ may be no more than 2:1, such as no more than 1.5:1, such as no more than 1.4:1, such as no more than 1.3:1, such as no more than 1.2:1, such as no more than 1.1:1. The ratio $W_G$:$W_S$ of the width of the water permeable geotextile material 110 $W_G$ to width of the stabilizer strap 140 $W_S$ may be from 1.1:1 to 2:1, such as 1.1:1 to 1.5:1, such as 1.1:1 to 1.4:1, such as 1.1:1 to 1.3:1, such as 1.1:1 to 1.2:1, such as 1.2:1 to 2:1, such as 1.2:1 to 1.5:1, such as 1.2:1 to 1.4:1, such as 1.2:1 to 1.3:1, such as 1.2:1 to 1.2:1, such as 1.3:1 to 2:1, such as 1.3:1 to 1.5:1, such as 1.3:1 to 1.4:1, such as 1.3:1 to 1.3:1, such as 1.3:1 to 1.2:1, such as 1.4:1 to 2:1, such as 1.4:1 to 1.5:1, such as 1.5:1 to 2:1.

The water permeable geotextile material 110 and optionally the stabilizer strap 140 may be constructed from any permeable material suitable for use as a geotextile. For example, the material may be a woven geotextile or a pocketed woven geotextile. The woven geotextile may comprise high-strength tensile plastics, laminations such as polyester or nylon, or plastics such as polypropylene, and other forms such as mono-filament or silt tapes. Combinations of such materials could also be used. For example, the geotextile material of the stabilizer strap 140 may have the same flow characteristics as the water permeable geotextile material 110, or may have greater apparent opening size, clean-water flux, and/or permittivity. The permeable geotextile material may have any suitable apparent opening size, flux and permittivity selected by those skilled in the art and measurable by standard tests such as ASTM D4751 and ASTM D4491 tests. The permeable geotextile material may have a substantially consistent apparent opening size, clean-water flux and permittivity in different regions, or such characteristics may be varied.

As shown in FIGS. 1 and 2, the horizontally extendable silt fence 100 may optionally further comprise a stabilizer pocket 150 running along at least a portion of the length of the lower edge 130 of the water permeable geotextile material 110.

The stabilizer pocket 150 may have any suitable diameter, such as, for example, a diameter of from 1 to 6 inches, such as 2 to 5 inches, such as 3 to 4 inches. The stabilizer pocket 150 forms a cavity that may be filled with a filler material such as, for example, sand, compost, wood chips, switch grass, or any other heavy, surface conformable materials, such as metal plates, or other suitable materials. Sand is a particularly suitable material due to a specific gravity of greater than one, low material cost, and high conformability to surfaces. The suitable materials could also be placed into removable filler-filled tube 170 that slides into and are positioned into at least a portion of the cavity of the stabilizer pocket 150 during installation. The filler-filled tube 170 or cavity of the stabilizer pocket 150 may also include coagulants and/or flocculants in addition to or instead of the filler materials listed above. The coagulants and/or flocculants could also be added as packets or pouches in the stabilizer strap 140 or between the permeable geotextile 110 and the stabilizer strap 140. The removable filler-filled tube 170 or stabilizer pocket 150 may be prefilled or may be filled at the site of installation. The removable filler-filled tube 170 or stabilizer pocket 150 may seal the lower edge 130 of the water permeable geotextile material 110 to prevent fluid from passing under the horizontally extendable silt fence 100 prior to the fence filling with fluid sufficient to weigh down the water permeable geotextile material 110 to the ground.

Figure 4:
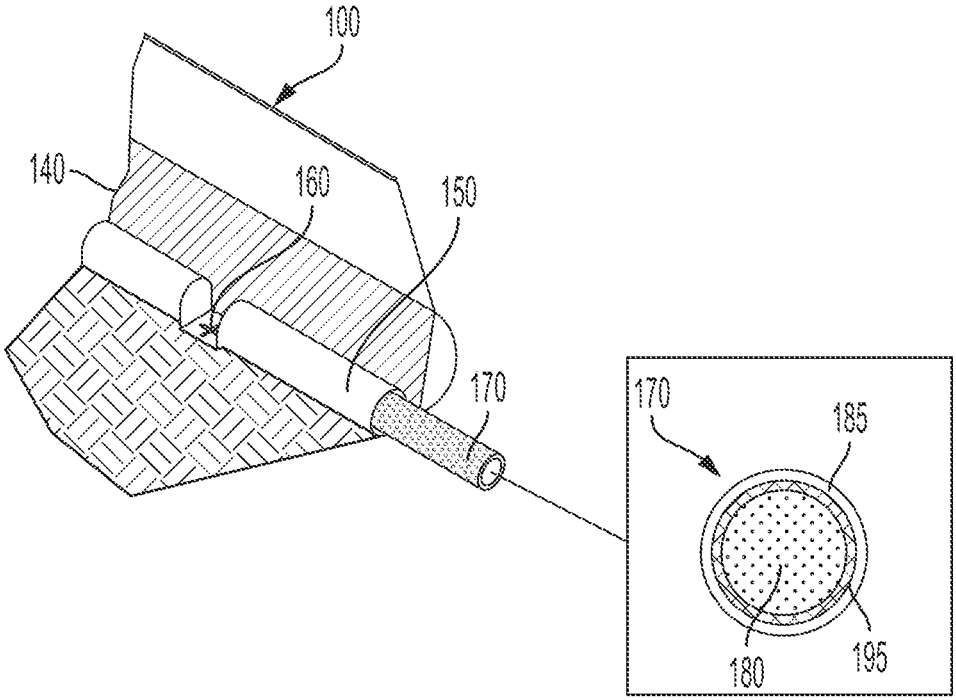
FIG. 4 is an isometric view and exploded view of the end of an exemplary stabilizer pocket of an exemplary silt fence system of the present invention.

As shown in FIG. 4, a removable filler-filled tube 170 may be inserted into the cavity of the stabilizer pocket 150. For example, a 3-inch outside-diameter (OD) tube of sand could weigh approximately four pounds per linear foot. The sand-filled, removable filler-filled tube 170 may comprise of a single wall or multiple walls of woven and non-woven materials encasing the filler material 180. In FIG. 4, the outer wall material 185 may comprise, for example, a hydrophobic spunbond polypropylene to provide water-absorption resistance and a low coefficient of friction for sliding into the cavity of stabilizer pocket 150. The inner wall material 195 may comprise, for example a woven polypropylene fabric to provide tensile and burst strength to resist breaking if dropped.

Figure 7:
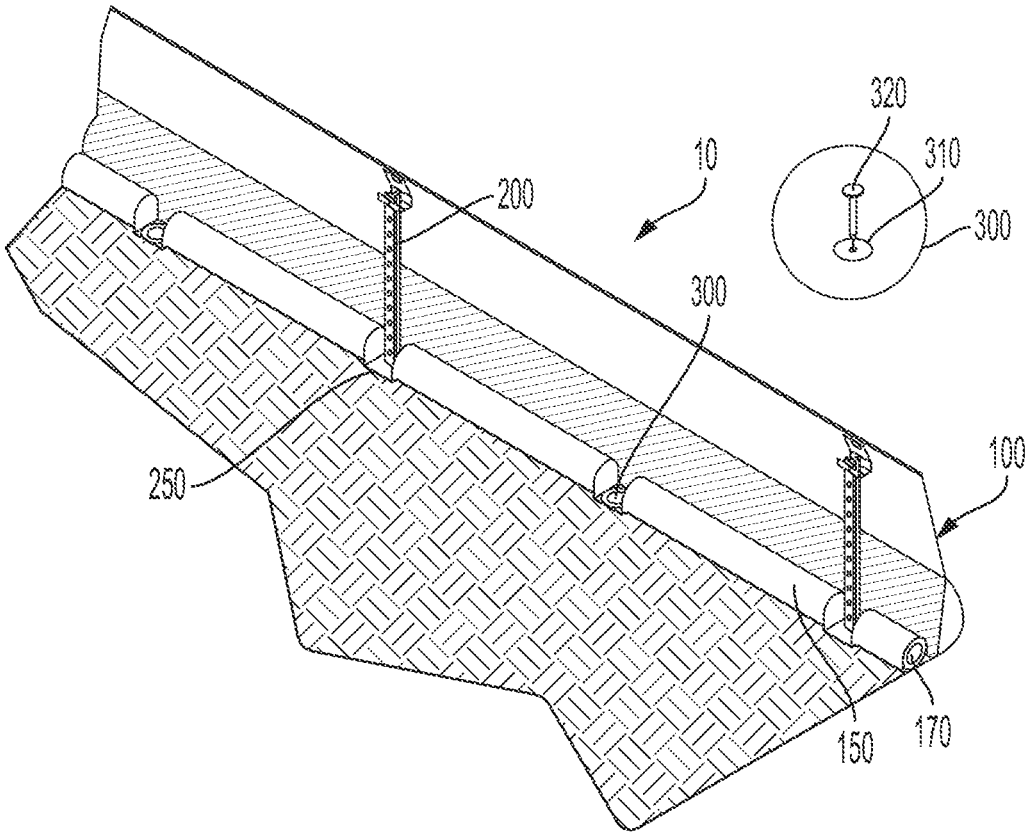
FIG. 7 is an isometric view of alternating posts and ground stakes of an exemplary silt fence system of the present invention.

The stabilizer pocket 150 may be continuous or discontinuous along the length of the horizontally movable silt fence 100, and the stabilizer pocket 150 may comprise non-filled portions. For example, as shown in FIG. 2, the stabilizer pocket extends the length of the horizontally extendable silt fence 100 and includes filled portions between the posts 200 and non-filled flat portions where the post is driven through the stabilizer pocket 150. The stabilizer pocket 150 may include openings to allow access to the cavity and may be located anywhere along the length of the stabilizer pocket 150. For example, the stabilizer pocket 150 may be include slits or openings where the water permeable geotextile material 110 is coupled to a post 200 or stake 300, as shown in FIG. 4 and FIG. 7. The stabilizer pocket 150 from the center or either side of the post may terminate at the post with a slit that allows for access of the cavity. The cavity of the stabilizer pocket 150 may optionally be sealed, covered or otherwise rendered inaccessible prior to or after a material filler is added. For example, as shown in FIG. 1 and FIG. 2, the depth plate 250 of the post 200 may have a sufficient size to cover of the terminal section of the stabilizer pocket 150 to render the cavity closed as the post 200 is driven into the ground.

The horizontally extendable silt fence 100 may be woven full width or in multiples of the width on a loom and split apart. The stabilizer strap 140 can also be split from a wider woven panel or same panel as the water permeable geotextile material 110. Alternatively, the water permeable geotextile material 110 and stabilizer strap 140 may be woven as a pocketed panel wherein two sets of horizontally extendable silt fence 100 are woven at the same time. In addition, the stabilizer pocket 150 may be integrally formed or subsequently fastened to the water permeable geotextile material 110.

Figure 3A:
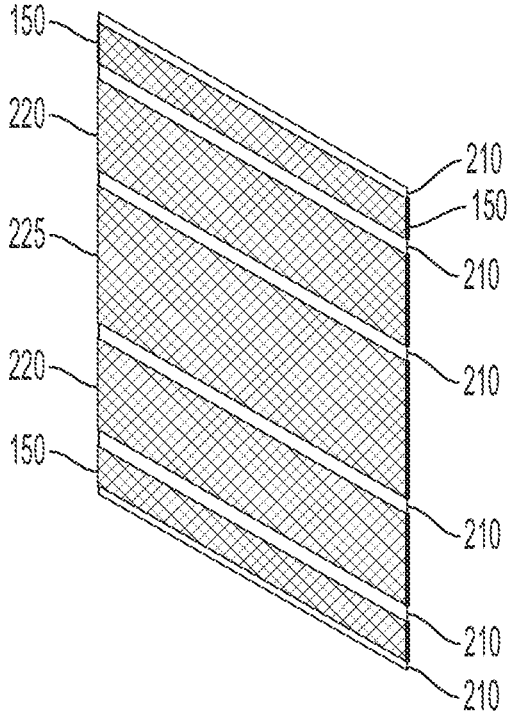
FIG. 3A is an isometric view of an exemplary geotextile portion of an exemplary silt fence of the present invention that comprises a double woven with a split panel section.
Figure 3B:
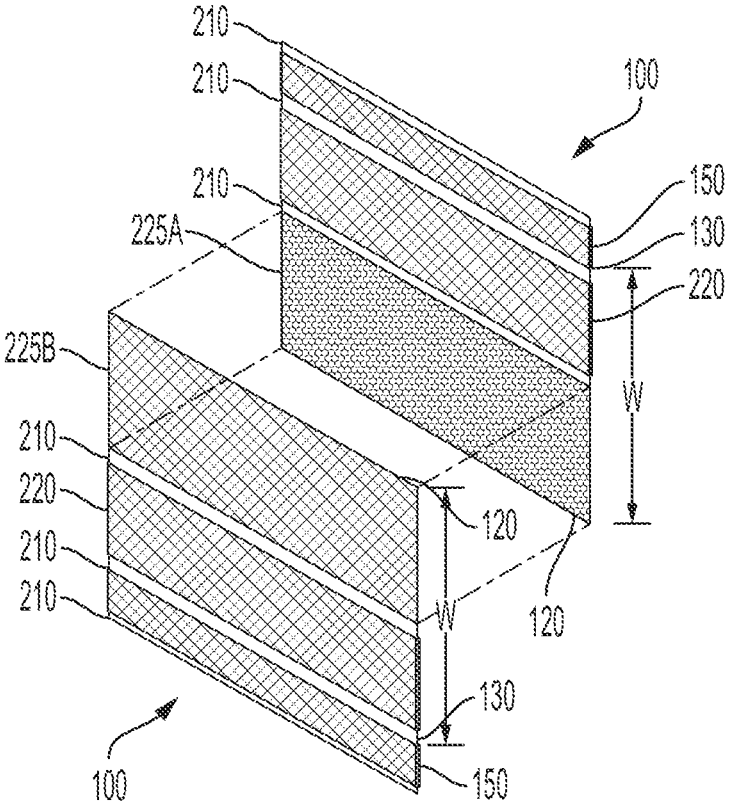
FIG. 3B is an isometric view of the same exemplary geotextile portion of an exemplary silt fence of the present invention that is split into two horizontally extendable silt fence panels by slicing the middle pocket open on alternating edges.

A non-limiting example of a multiple width horizontally extendable silt fence 100 that may be split into two horizontally extendable silt fence 100 section is shown in FIG. 3A and FIG. 3B. In FIG. 3A, two sections of horizontally extendable silt fence 100 are woven together into a two-layer panel split into five-pocketed sections by double panel fastening zones 210 that fasten the two layers. The five-pocketed panel may then split into two horizontally extendable silt fence 100 panels by slicing the middle pocket 225 open on alternating edges, as shown in FIG. 3B. For example, the top woven layer is cut against the top edge of the middle pocket and the bottom layer is cut against the bottom edge of the middle pocket to split into two single-layer panels 225A and 225B. The stabilizer pocket 150 is integrally formed as a pocket of material, and the stabilizer strap 140 optionally may be integrally formed by shortening a single-layer of material formed by the stabilizer strap pocket 220 such as by folding the layer of material and sewing it over to the correct ratio of stabilizer strap 140 width. For example, in FIG. 3B, a single layer of the stabilizer strap pocket 220 can be stitched over on one side 1 to 3 inches to shorten relative to the other layer of geotextile of the stabilizer strap pocket 220 to form an integrated stabilizer strap 140.

Figure 3C:
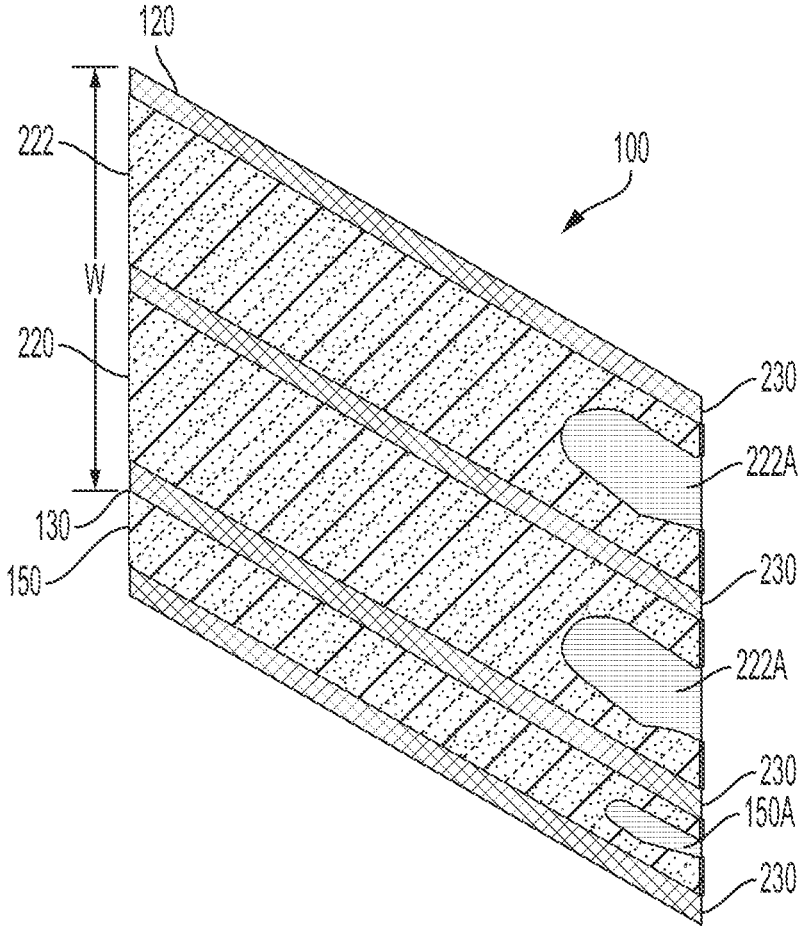
FIG. 3C is an isometric view of an exemplary geotextile portion of an exemplary silt fence of the present invention comprising an ultrasonic welded double panel with a double layer upper edge.

The stabilizer pocket 150 may be integrally formed by folding over an end of the water permeable geotextile material 100 and fastening it to form the tubular structure. The stabilizer pocket 150 may also be added by fastening a premade tube of material to the bottom of the lower edge 130 of the water permeable geotextile material 110. In addition, as discussed above, the stabilizer pocket 150 may be formed as an integral pocket in the woven pocketed design shown in FIG. 3A and FIG. 3B directly from the loom, or by welding two panels together, as shown in FIG. 3C.

The upper edge 120 of the water permeable geotextile material 110 may also be folded over and attached to itself by sewing or welding to double the material thickness where the silt fence is attached to the post 200 in order to reinforce the upper edge 120 of the geotextile material. Another double woven zone could also be present in the center to achieve double layer thickness at the upper edge 120 of the water permeable geotextile material 110 when the panels are cut apart. An ultrasonically welded option is shown FIG. 3C, where the flattened stabilizer pocket 150, the flattened stabilizer strap pocket 220, and a flattened double layer pocket 222 are formed by welding two geotextile panels together with ultrasonic bonds 230. FIG. 3C includes a cutout portions 150A, 220A, and 222A to show the second layer of geotextile material in each of the three pockets. If the panels are the same width, the upper edge 120 of the water permeable geotextile material 110 would be at double thickness due to two layers of material. Another option is to stop the upper panel at the top of the stabilizer pocket 220 and keep the upper edge 120 as a single layer of geotextile material. The upper edge 120 of the water permeable geotextile material 110 can also optionally be folded over and attached to itself by sewing or welding to double the material thickness where the silt fence is attached to the post 200. Instead of ultrasonic welding, heat welding via hot air, or a heated wedge are also non-limiting examples of processes that could be used to form the water permeable geotextile material 110 of the horizontally extendable silt fence 100. The water permeable geotextile material 110 of the horizontally extendable silt fence 100 alternatively could be sewn together, or a combination of joining methods could be used.

The posts 200 comprise an upper portion that is structured and arranged to be coupled with the upper edge 120 of the water permeable geotextile material 110 and an anchor portion structured and arranged to be driven into the ground to anchor the post 200. The post 200 and the upper edge 120 of the water permeable geotextile material 110 may comprise any suitable structure for coupling the components together. The structure for coupling may comprise any structure appropriate for the intended use. For example, the coupling may be by staples, zip ties, string, wire, fasteners, or any other suitable method. The post 200 may optionally comprise a hook or apertures for receiving zip ties, string, or the like for securing to the upper edge 120 of the water permeable geotextile material 110. The post 200 may also comprise a lower portion structured and arranged to be coupled with the lower edge 130 of the water permeable geotextile material 110. For example, the post 200 may be driven directly into the lower edge 130 of the water permeable geotextile material 110.

The upper portion of the post 200 may optionally comprise an angled top plate 240 structured and arranged to be coupled with the upper edge 120 of the water permeable geotextile material 110, as shown in FIG. 1 and FIG. 2. The angled top plate 240 helps to maintain the concave shape to reduce the horizontal force on the attachment points while the depth plate 250 stops the post from being driven too far into the ground while also to keeping the water permeable geotextile material 110 flat between the tube positions 150 to allow sediment water to easily pass between the sand tubes while filling up. The angled top plate 240 may comprise any suitable structure for coupling the components together for the intended use. For example, the angled top plate 240 includes a pin to attach through a hole in the post 200 and apertures for receiving zip ties, string, or the like for securing the upper edge 120 of the geotextile 110. The angled top plate 240 could be a cap or bent plate placed over the end of the post 200. The bent plate version is shown in FIG. 1 and FIG. 2 since the bent plate is less costly to manufacture. The angled top plate 240 may form an angle of from 5° to 30°, as measured from the post 200.

As shown in FIGS. 1 and 2, the lower portion of the post 200 may optionally comprise a depth plate 250 extending horizontally from the post 200 adjacent to the anchor portion of the post 200. The depth plate 250 may be structured and arranged to be coupled with the lower edge 130 of the water permeable geotextile material 110. The depth plate 250 also provides the installer with visual confirmation that the post is driven deep enough into the ground and may assist in securing the water permeable geotextile material 110 to the ground. This helps to ensure a more stable silt fence system 10 that is less prone to installer error. The depth plate 250 is positioned on the post 200 such that an adequate amount of the total length of the anchor portion of the post 200 is driven into the ground to adequately anchor the post 200, such as, for example, 6 to 24 inches, such as 10-14 inches. The depth plate 250 may also serve to secure the stabilizer pocket 150, if present, in place, and the horizontally extended area of the depth plate 250 may provide a low-profile entrance for the water to start filling the horizontally extendable silt fence 100 behind the stabilizer pocket 150. This reduces the water pressure against the stabilizer pocket 150 as the horizontally extendable silt fence 100 starts to fill.

The post 200 may comprise wood, metal, or any other suitable material. The post 200 may have a total length of at least 24 inches, such as at least 32 inches, such as at least 36 inches, such as at least 48 inches, such as at least 60 inches. The post 200 may have a total length of no more than 60 inches, such as no more than 48 inches, such as no more than 40 inches, such as no more than 38 inches. The post 200 may have a total length of 24 to 60 inches, such as 24 to 48 inches, such as 24 to 40 inches, such as 24 to 38 inches, such as 32 to 60 inches, such as 32 to 48 inches, such as 32 to 40 inches, such as 32 to 38 inches, such as 36 to 60 inches, such as 36 to 48 inches, such as 36 to 40 inches, such as 36 to 38 inches, such as 48 to 60 inches, such as 36 inches.

The total length of the post 200 driven into the ground (i.e., anchor portion) is not limited so long as the depth adequately anchors the post 200. The total length of the post 200 driven into the ground may be at least 6 inches, such as at least 10 inches, such as at least 12 inches, such as at least 24 inches. The total length of the post 200 driven into the ground may be no more than 42 inches, such as no more than 36 inches, such as no more than 24 inches, such as no more than 16 inches, such as no more than 12 inches. The total length of the post 200 driven into the around may be from 6 to 42 inches, such as 6 to 36 inches, such as 6 to 30 inches, such as 6 to 24 inches, such as 6 to 16 inches, such as 6 to 12 inches, such as 10 to 42 inches, such as 10 to 36 inches, such as 10 to 30 inches, such as 10 to 24 inches, such as 10 to 16 inches, such as 10 to 12 inches, such as 12 to 42 inches, such as 12 to 36 inches, such as 12 to 24 inches, such as 12 to 16 inches, such as 24 to 42 inches, such as 24 to 36 inches, such as 24 to 30 inches.

As shown in FIG. 4, the water permeable geotextile material 110 may optionally comprise an aperture 160 adjacent to the lower edge 130. The aperture 160 may be circular, a slit, cross shaped, t-shaped, or any other shape. The aperture 160 of FIG. 4 is t-shaped to fit the t-shaped post 200. The water permeable geotextile material 110 may be positioned such that the aperture 160 is positioned on the ground and the post 200 may be driven into the ground through the aperture 160 to couple the lower edge of the water permeable geotextile material to the post and secure the horizontally extendable silt fence 100 in place. The aperture 160 reduces pulling the water permeable geotextile material 110 into the ground while the post 200 is driven in; however, the post 200 could be driven through and pierce the water permeable geotextile material 110 without an aperture 160 being present.

Once installed, as shown in FIG. 1, the height "H" of the horizontally extendable silt fence 100 as measured from the coupling of the upper edge 120 and lower edge 130 of the water permeable geotextile material 110 to the post 200 may be at least 12 inches, such as at least 18 inches, such as at least 22 inches, such as at least 30 inches. The height H of the horizontally extendable silt fence 100 as measured from the coupling of the upper edge 120 and lower edge 130 of the water permeable geotextile material 110 to the post 200 may be no more than 48 inches, such as no more than 36 inches, such as no more than 24 inches, such as no more than 18 inches. The height H of the horizontally extendable silt fence 100 as measured from the coupling of the upper edge 120 and lower edge 130 of the water permeable geotextile material 110 to the post 200 may be from 12 to 48 inches, such as 18 to 48 inches, such as 22 to 48 inches, such as 30 to 48 inches, such as 12 to 36 inches, such as 18 to 36 inches, such as 22 to 36 inches, such as 30 to 36 inches, such as 12 to 24 inches, such as 18 to 24 inches, such as 22 to 24 inches, such as 12 to 18 inches.

The ratio W:H of the total width ("W") of the geotextile material of the water permeable geotextile material 110 measured from the upper edge 120 to the lower edge 130, as shown in FIG. 3C, to the height ("H") of the horizontally extendable silt fence 100, as shown in FIG. 1, may be at least 1.05:1, such as at least 1.1:1, such as at least 1.2:1, such as at least 1.3:1, such as at least 1.5:1, such as at least 2:1. The ratio W:H of the total width of the geotextile of the water permeable geotextile material 110 measured from the upper edge 120 to the lower edge 130 to the height of the horizontally extendable silt fence 100 may be no more than 10:1, such as no more than 5:1, such as no more than 4:1, such as no more than 3:1, such as no more than 2:1, such as no more than 1.5:1, such as no more than 1.4:1. The ratio W:H of the total width of the geotextile of the water permeable geotextile material 110 measured from the upper edge 120 to the lower edge 130 to the height of the horizontally extendable silt fence 100 may be from 1.05:1 to 10:1, such 1.05:1 to 5:1, such as 1.05:1 to 4:1, such as 1.05:1 to 3:1, such as 1.05:1 to 2:1, such as 1.05:1 to 1.5:1, such as 1.05:1 to 1.4:1, such as 1.1:1 to 10:1, such as 1.1:1 to 5:1, such as 1.1:1 to 4:1, such as 1.1:1 to 3:1, such as 1.1:1 to 2:1, such as 1.1:1 to 1.5:1, such as 1.1 to 1.4:1, such as 1.2:1 to 10:1, such as 1.2:1 to 5:1, such as 1.2:1 to 4:1, such as 1.2:1 to 3:1, such as 1.2:1 to 2:1, such as 1.2:1 to 1.5:1, such as 1.2:1 to 1.5:1, such as 1.3:1 to 10:1, such as 1.3:1 to 5:1, such as 1.3:1 to 4:1, such as 1.3:1 to 3:1, such as 1.3:1 to 2:1, such as 1.5:1 to 10:1, such as 1.5:1 to 5:1, such as 1.5:1 to 4:1, such as 1.5:1 to 3:1, such as 1.5:1 to 2:1, such as 2:1 to 10:1, such as 2:1 to 5:1, such as 2:1 to 4:1, such as 2:1 to 3:1.

The ratio H:D of the height H of the horizontally extendable silt fence 100, as shown in FIG. 1, to the displacement distance D of the horizontally extendable silt fence 100 from the post 200 in an extended state, as shown in FIG. 1, may be at least 1:1, such as at least 2:1, such as at least 3:1, such as at least 4:1. The ratio H:D of the height H of the horizontally extendable silt fence 100, as shown in FIG. 1, to the displacement distance D of the horizontally extendable silt fence 100 in an extended state, as shown in FIG. 1, may be no more than 20:1, such as no more than 10:1, such as no more than 5:1, such as no more than 4:1. The ratio H:D of the height H of the horizontally extendable silt fence 100, as shown in FIG. 1, to the displacement distance D of the horizontally extendable silt fence 100 in an extended state, as shown in FIG. 1, may be from 1:1 to 20:1, such as 1:1 to 10:1, such as 1:1 to 5:1, such as 1:1 to 4:1, such as 2:1 to 20:1, such as 2:1 to 10:1, such as 2:1 to 5:1, such as 2:1 to 4:1, such as 3:1 to 20:1, such as 3:1 to 10:1, such as 3:1 to 5:1, such as 3:1 to 4:1, such as 4:1 to 20:1, such as 4:1 to 10:1, such as 4:1 to 5:1.

Figure 5:
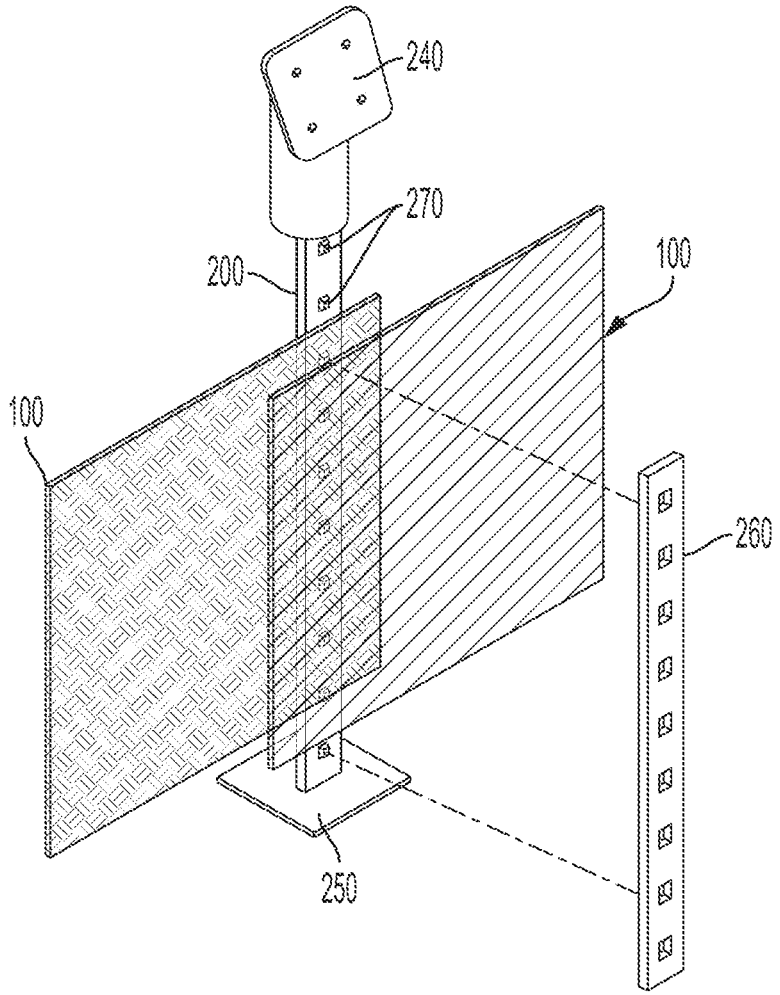
FIG. 5 shows a partially schematic diagram of an exemplary silt fence system showing two sections of horizontally extendable silt fence being joined and secured to a post using an engaging member.

The length of the horizontally extendable silt fence 100 of the silt fence system 10 is not particularly limited and may be adjusted according to the specific needs of the user, such as by cutting the horizontally extendable silt fence 100 or by fastening two or more sections of horizontally extendable silt fence 100 together by, for example, sewing or by using a post 200 structured and arranged to secure the horizontally extendable silt fence 100 to the post 200. For example, FIG. 5 is a partially schematic diagram showing that the post 200 may be structured and arranged to secure the horizontally extendable silt fence 100 between the post 200 and an engaging member 260. The partially schematic diagram of FIG. 5 is not shown in the other figures. It will be understood that the horizontally extendable silt fence 100 will not be in an extended position at the post 200 when attached in this manner and may be attached higher on the post 200 than the height of the rest of the horizontally extendable silt fence 100 or partially folded on to itself in order to be secured to the post 200 in this configuration. Alternatively, a portion of the horizontally extendable silt fence 100 may be removed or a portion of material may be added to form a flap at the end of a length of the horizontally extendable silt fence 100 that runs along a portion of the width of the horizontally extendable silt fence 100 in order to be joined to the post 200. The two sections of horizontally extendable silt fence 100 overlap on the post 200 and the engaging member 260 locks onto the post 200 to secure the sections of horizontally extendable silt fence 100 remain in place between the post 200 and engaging member 260. In FIG. 5, the post 200 also includes a series of protrusions 270 that are structured and arranged to couple with the apertures of the engaging member 260. The series of protrusions 270 may lock into the apertures of the engaging member 260 and secure it in place with the sections of horizontally extendable silt fence 100 secured between the post 200 and engaging member 260. The protrusions 270 may secure the horizontally extendable silt fence 100 by direct contact or by piercing through the horizontally extendable silt fence 100. Alternatively, the engaging member 260 may secured to the post 200 by, for example, staples, screws, nails, plastic ties, wire, and the like. The post configuration shown in FIG. 5 may also be used to secure a terminal end of the horizontally extendable silt fence 100 wherein only one section of horizontally extendable silt fence 100 is secured by the post 200 and engaging member 260. Although the engaging member is in the form of a plate-like structure in FIG. 5, the engaging member 260 may comprise any material structured and arranged to secure one or more sections of the horizontally extendable silt fence 100 to the post, such as, for example, staples, screws, nails, plastic ties, wire, and the like.

Figure 6:
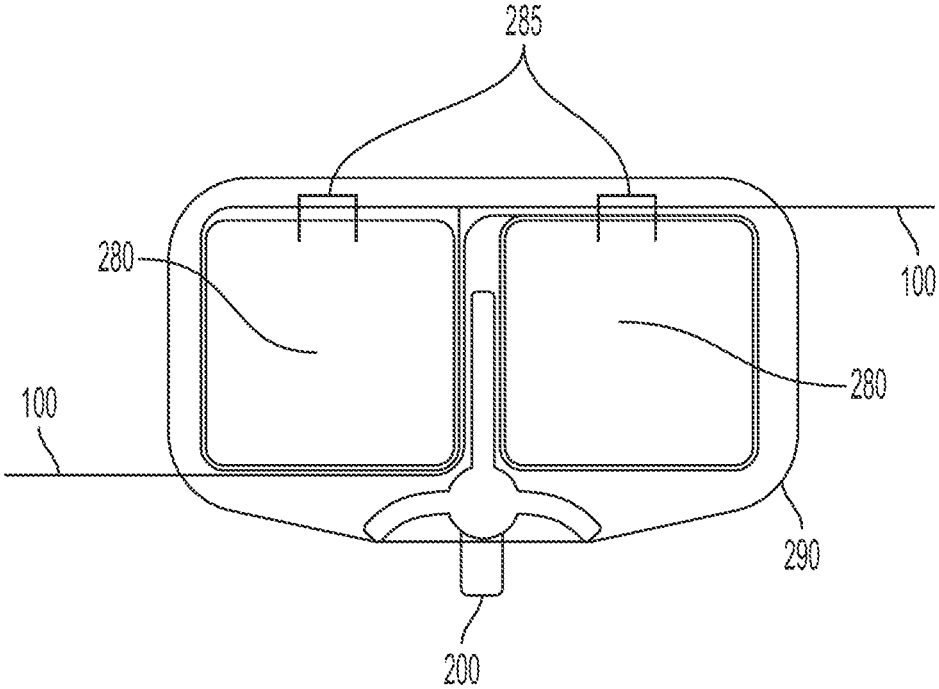
FIG. 6 is a top view of an exemplary silt fence system showing two sections of horizontally extendable silt fence being joined and secured to a post by overlapping support slats.

Sections of the horizontally extendable silt fence 100 of the silt fence system 10 may also be joined at individual posts 200. For example, as shown in FIG. 6, the post 200 may be structured and arranged to secure the ends of portions of the horizontally extendable silt fence 100 sections that include support slats 280 that create an overlap joint at a post that secures the horizontally extendable silt fence 100 sections. The post 200 may have a T-stake configuration overlapped by one or more support slats 280 that are fastened to a horizontally extendable silt fence 100 section to form an overlap joint by, for example, staples, screws, nails, plastic ties, wire, and the like. The support slats 280 could also be enclosed in pockets sewn into the silt fence. For example, as shown in FIG. 6, staples 285 are used to secure two ends of the horizontally extendable silt fence 100 sections to the support slats 280. The support slats 280 may be secured to the post 200 by one or more of, for example, staples, screws, nails, plastic ties, wire, and the like, to form an overlap joint at the post 200. For example, in FIG. 6, plastic zip ties 290 are used.

When the silt fence system 10 is installed, the posts 200 of the silt fence system 10 are placed uphill from the horizontally extendable silt fence 100. Enough posts 200 should be used to adequately support the horizontally extendable silt fence 100. For example, a post could be installed for about every 3 to 4 feet of the length of the horizontally extendable silt fence 100; however, more or less posts 200 could be used. The posts 200 may be spaced equidistant from each other along the length of the silt fence system 10, for example, as shown in FIG. 2, or in more random patterns to account for different terrains, such as a higher post density in areas expected to receive more runoff water.

As shown in FIG. 7, the silt fence system 10 may optionally further comprise ground stakes 300 to secure the horizontally extendable silt fence 100 to the ground. For example, as shown in FIG. 7, the ground stakes 300 may be used in addition to the posts 200 in order to secure the horizontally extendable silt fence 100 to the ground. The ground stakes 300 may be equidistantly spaced from the posts 200 along the length of the horizontally extendable silt fence system 10, for example, as shown in FIG. 7, or in more random patterns to account for different terrains. In addition, more than one ground stake 300 may be used between individual posts 200 if needed. In an exemplary horizontally extendable silt fence system 10, the posts 200 may be equally spaced, for example, about 8 feet apart with ground stakes 300 placed equidistant from each post 200, i.e., about 4 feet from each post 200. The ground stakes 300 may also assist in securing the stabilizer pocket 150, when present, to the ground by driving the ground stake 300 through the stabilizer pocket 150, as shown in FIG. 7. The ground stake 300 may further assist in preventing sand-filled tubes 170, when present, from shifting out of the stabilizer pocket 150 pockets by clamping the stabilizer pocket 150 closed to the ground. The clamping to the ground is similar in function to the depth plate 250 but without the need for a full post 200. The ground stakes 300 may optionally have a large surface head to bridge the aperture 160 and space between the stabilizer pocket 150 openings. The large surface area head could be 2 inches to 7 inches across and can be any shape, such as square or round. The large surface head could be provided by a washer 310 used with a smaller head stake 320, as shown in FIG. 7.

The present invention is also directed to a method of filtering silt from a fluid stream. The method comprises installing the silt fence system 10 of the present invention in the path of the fluid stream with the horizontally extendable silt fence 100 downhill from the posts 200.

The present invention is also directed towards a method of installing the silt fence system 10 of the present invention, the method comprising the steps of positioning the horizontally extendable silt fence 100 downhill from a fluid stream; optionally placing sand-filled tubes 170 into the stabilizer pocket 150; driving a plurality of posts 200 through the apertures 160 adjacent to the lower edge 130 of the water permeable geotextile material a sufficient depth or until the depth plate 250 reaches the ground (if present); optionally driving in ground stakes 300 (for example, if posts 200 are only used at every other aperture 160); optionally attaching the angled top plate 240 (if used and not pre-attached to the post 200); and coupling the upper edge 120 of the water permeable geotextile material to the post 200, such as to the angled top plate 240.

For purposes of this detailed description, it is to be understood that the invention may assume alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

As used herein, "including," "containing" and like terms are understood in the context of this application to be synonymous with "comprising" and are therefore open-ended and do not exclude the presence of additional undescribed or unrecited elements, materials, ingredients or method steps. As used herein, "consisting of" is understood in the context of this application to exclude the presence of any unspecified element, ingredient or method step. As used herein, "consisting essentially of" is understood in the context of this application to include the specified elements, materials, ingredients or method steps "and those that do not materially affect the basic and novel characteristic(s)" of what is being described.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Whereas specific aspects of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the fill breadth of the claims appended and any and all equivalents thereof.

In view of the foregoing, the present invention thus relates in particular, without being limited thereto, to the following aspects: A first aspect is directed to a horizontally extendable silt fence comprising a water permeable geotextile material having an upper edge and a lower edge. A second aspect is directed to the horizontally extendable silt fence of the first aspect, further comprising a stabilizer strap fastened at an upper location below the upper edge and a lower location at or above the lower edge to form a water retention pocket, wherein a width of the stabilizer strap $W_S$ measured from the upper location to the lower location of the water permeable geotextile material is less than a width of the water permeable geotextile material $W_G$ measured from the upper location to the lower location. A third aspect is directed to the horizontally extendable silt fence of any of the preceding aspects, wherein a ratio $W_G$:$W_S$ of the width of the water permeable geotextile material Wu to width of the stabilizer strap $W_S$ is from 1.1:1 to 2:1, such as 1.1:1 to 1.5:1, such as 1.1:1 to 1.4:1, such as 1.1:1 to 1.3:1, such as 1.1:1 to 1.2:1, such as 1.2:1 to 2:1, such as 1.2:1 to 1.5:1, such as 1.2:1 to 1.4:1, such as 1.2:1 to 1.3:1, such as 1.2:1 to 1.2:1, such as 1.3:1 to 2:1, such as 1.3:1 to 1.5:1, such as 1.3:1 to 1.4:1, such as 1.3:1 to 1.3:1, such as 1.3:1 to 1.2:1, such as 1.4:1 to 2:1, such as 1.4:1 to 1.5:1, such as 1.5:1 to 2:1. A fourth aspect is directed to the horizontally extendable silt fence of any of the preceding aspects, further comprising a stabilizer pocket running along at least a portion of the length of the lower edge of the water permeable geotextile material. A fifth aspect is directed to the horizontally extendable silt fence of any of the fourth aspect, wherein the stabilizer pocket forms a cavity and a removable filler-filled tube is positioned in at least a portion of the cavity. A sixth aspect is directed to the horizontally extendable silt fence of any of the preceding aspects, wherein the water permeable geotextile material further comprises an aperture adjacent to the lower edge. A seventh aspect is directed to a silt fence system comprising the horizontally extendable silt fence of any of the preceding aspects and a plurality of posts. An eighth aspect is directed to a silt fence system comprising a horizontally extendable silt fence comprising a water permeable geotextile material having an upper edge and a lower edge and a width measured from the upper edge to the lower edge; and a plurality of posts comprising an upper portion structured and arranged to be coupled with the upper edge of the water permeable geotextile material; a lower portion structured and arranged to be coupled with the lower edge of the water permeable geotextile material; and an anchor portion structured and arranged to be driven into the ground to anchor the post, wherein the horizontally extendable silt fence has a height measured from the coupling of the upper edge and lower edge of the water permeable geotextile material to the post, and a ratio W:H of a width of the geotextile of the water permeable geotextile material W to a height H of the horizontally extendable silt fence is at least 1.05:1. A ninth aspect is directed to the silt fence system of the eighth aspect, wherein the horizontally extendable silt fence comprises any of the horizontally extendable silt fences of the first through seventh aspects. A tenth aspect is directed to a silt fence system of the eighth or ninth aspect, wherein the horizontally extendable silt fence has a height measured from the coupling of the upper edge and lower edge of the water permeable geotextile material to the post, and a ratio W:H of a width of the geotextile of the water permeable geotextile material W to a height H of the horizontally extendable silt fence is from 1.05:1 to 10:1, such 1.05:1 to 5:1, such as 1.05:1 to 4:1, such as 1.05:1 to 3:1, such as 1.05:1 to 2:1, such as 1.05:1 to 1.5:1, such as 1.05:1 to 1.4:1, such as 1.1:1 to 10:1, such as 1.1:1 to 5:1, such as 1.1:1 to 4:1, such as 1.1:1 to 3:1, such as 1.1:1 to 2:1, such as 1.1:1 to 1.5:1, such as 1.1 to 1.4:1, such as 1.2:1 to 10:1, such as 1.2:1 to 5:1, such as 1.2:1 to 4:1, such as 1.2:1 to 3:1, such as 1.2:1 to 2:1, such as 1.2:1 to 1.5:1, such as 1.2:1 to 1.5:1, such as 1.3:1 to 10:1, such as 1.3:1 to 5:1, such as 1.3:1 to 4:1, such as 1.3:1 to 3:1, such as 1.3:1 to 2:1, such as 1.5:1 to 10:1, such as 1.5:1 to 5:1, such as 1.5:1 to 4:1, such as 1.5:1 to 3:1, such as 1.5:1 to 2:1, such as 2:1 to 10:1, such as 2:1 to 5:1, such as 2:1 to 4:1, such as 2:1 to 3:1. An eleventh aspect is directed to the silt fence system of any of preceding aspects 8-10, wherein the horizontally extendable silt fence is structured and arranged to be horizontally displaced a displacement distance D from the post, and a ratio H:D of the height H of the horizontally extendable silt fence to the displacement distance D is from 1:1 to 20:1, such as 1:1 to 10:1, such as 1:1 to 5:1, such as 1:1 to 4:1, such as 2:1 to 20:1, such as 2:1 to 10:1, such as 2:1 to 5:1, such as 2:1 to 4:1, such as 3:1 to 20:1, such as 3:1 to 10:1, such as 3:1 to 5:1, such as 3:1 to 4:1, such as 4:1 to 20:1, such as 4:1 to 10:1, such as 4:1 to 5:1. A twelfth aspect is directed to the silt fence system of any of preceding aspects 8-11, wherein the horizontally extendable silt fence further comprises a stabilizer strap fastened at an upper location below the upper edge and a lower location at or above the lower edge to form a water retention pocket, wherein a width of the stabilizer strap $W_S$ measured from the upper location to the lower location of the water permeable geotextile material is less than a width of the water permeable geotextile material $W_G$ measured from the upper location to the lower location. A thirteenth aspect is directed to the silt fence system of any of preceding aspects 8-12, wherein a ratio $W_G$:$W_S$ of the width of the water permeable geotextile material $W_G$ to width of the stabilizer strap $W_S$ is from 1.1:1 to 2:1, such as 1.1:1 to 1.5:1, such as 1.1:1 to 1.4:1, such as 1.1:1 to 1.3:1, such as 1.1:1 to 1.2:1, such as 1.2:1 to 2:1, such as 1.2:1 to 1.5:1, such as 1.2:1 to 1.4:1, such as 1.2:1 to 1.3:1, such as 1.2:1 to 1.2:1, such as 1.3:1 to 2:1, such as 1.3:1 to 1.5:1, such as 1.3:1 to 1.4:1, such as 1.3:1 to 1.3:1, such as 1.3:1 to 1.2:1, such as 1.4:1 to 2:1, such as 1.4:1 to 1.5:1, such as 1.5:1 to 2:1. A fourteenth aspect is directed to the silt fence system of any of preceding aspects 8-13, wherein the water permeable geotextile material further comprises an aperture adjacent to the lower edge and the post is driven into the ground through the aperture to couple the lower edge of the water permeable geotextile material to the post. A fifteenth aspect is directed to the silt fence system of any of preceding aspects 8-14, further comprising a stabilizer pocket running along at least a portion of the length of the lower edge of the water permeable geotextile material. A sixteenth aspect is directed to the silt fence system of any of preceding aspects 8-15, wherein the stabilizer pocket forms a cavity, and a removable filler-filled tube is positioned in at least a portion of the cavity. A seventeenth aspect is directed to the silt fence system of any of preceding aspects 8-16, wherein the stabilizer pocket further comprises an aperture adjacent to the lower edge of the water permeable geotextile material and the post is driven into the ground through the aperture to couple the lower edge of the water permeable geotextile material to the post. An eighteenth aspect is directed to the silt fence system of any of preceding aspects 8-17, the post further comprises a depth plate extending horizontally from the post between the lower portion and the anchor portion of the post. A nineteenth aspect is directed to the silt fence system of any of preceding aspects 8-18, wherein the post comprises an angled top plate structed and arranged to be coupled with the upper edge of the water permeable geotextile material. A twentieth aspect is directed to the silt fence system of any of preceding aspects 8-19, wherein the system further comprises at least one post comprising an engaging member structured and arranged to secure a portion of the geotextile material between the at least one post and the engaging member. A twenty first aspect is directed to the silt fence system of any of preceding aspects 8-20, wherein the system further comprises at least one support slat that is structured an arranged to form an overlap joint at the posts to secure a portion of the geotextile material between the at least one post and the support slat. A twenty second aspect is directed to the silt fence system of any of preceding aspects 8-21, wherein the system further comprises at least one ground stake driven into the ground adjacent to the lower edge of the water permeable geotextile material. A twenty third aspect is directed to a method of filtering silt from a fluid stream, the method comprising installing the silt fence system of any of aspects 8-22 in the path of the fluid stream with the horizontally extendable silt fence positioned downhill from the posts.

It will be appreciated by skilled artisans that numerous modifications and variations are possible in light of the above disclosure without departing from the broad inventive concepts described and exemplified herein. Accordingly, it is therefore to be understood that the foregoing disclosure is merely illustrative of various exemplary aspects of this application and that numerous modifications and variations can be readily made by skilled artisans which are within the spirit and scope of this application and the accompanying claims.

What is claimed is:

1. A horizontally extendable silt fence comprising:

a water permeable geotextile material having an upper edge and a lower edge, a stabilizer strap fastened at an upper location below the upper edge and a lower location at or above the lower edge to form a water retention pocket, wherein a width of the stabilizer strap $W_s$ measured from the upper location to the lower location of the water permeable geotextile material is less than a width of the water permeable geotextile material $W_G$ measured from the upper location to the lower location, and a stabilizer pocket running along at least a portion of the length of the lower edge of the water permeable geotextile material, wherein the stabilizer pocket forms a cavity and a removable filler-filled tube is positioned in at least a portion of the cavity.

2. The horizontally extendable silt fence of claim 1, wherein a ratio $W_G$:$W_s$ of the width of the water permeable geotextile material $W_G$ to the width of the stabilizer strap $W_s$ is from 1.1:1 to 2:1.

3. The horizontally extendable silt fence of claim 2, wherein the stabilizer strap comprises a water permeable material.

4. The horizontally extendable silt fence of claim 1, wherein the removable filler-filled tube is filled with a filler material comprising sand.

5. A silt fence system comprising:

a horizontally extendable silt fence comprising a water permeable geotextile material having an upper edge and a lower edge and a width measured from the upper edge to the lower edge; and a plurality of posts comprising an upper portion structured and arranged to be coupled with the upper edge of the water permeable geotextile material; a lower portion structured and arranged to be coupled with the lower edge of the water permeable geotextile material; and an anchor portion structured and arranged to be driven into the ground to anchor the post, wherein the horizontally extendable silt fence has a height measured from the coupling of the upper edge and lower edge of the water permeable geotextile material to the post, and a ratio W:H of the width of the geotextile of the water permeable geotextile material W to the height H of the horizontally extendable silt fence is at least 1.05:1, wherein the horizontally extendable silt fence further comprises a stabilizer strap fastened at an upper location below the upper edge and a lower location at or above the lower edge to form a water retention pocket, wherein a width of the stabilizer strap $W_s$ measured from the upper location to the lower location of the water permeable geotextile material is less than a width of the water permeable geotextile material $W_G$ measured from the upper location to the lower location.

6. The silt fence system of claim 5, wherein the horizontally extendable silt fence is structured and arranged to be horizontally displaced a displacement distance D from the post, and a ratio H:D of the height H of the horizontally extendable silt fence to the displacement distance D is from 1:1 to 20:1.

7. The silt fence system of claim 5, wherein a ratio $W_G$:$W_s$ of the width of the water permeable geotextile material $W_G$ to width of the stabilizer strap $W_s$ is from 1.1:1 to 2:1.

8. The silt fence system of claim 5, wherein a distance $D_P$ between the water permeable geotextile material and the stabilizer strap of the water retention pocket is from 2 to 36 inches.

9. The silt fence system of claim 5, wherein the stabilizer strap comprises a water permeable material.

10. The silt fence system of claim 5, further comprising a stabilizer pocket running along at least a portion of the length of the lower edge of the water permeable geotextile material.

11. The silt fence system of claim 10, wherein the stabilizer pocket forms a cavity, and a removable filler-filled tube is positioned in at least a portion of the cavity.

12. The silt fence system of claim 5, wherein the lower portion of at least one of the posts further comprises a depth plate extending horizontally from the post adjacent to the anchor portion of the post.

13. The silt fence system of claim 5, wherein the upper portion of at least one of the posts comprises an angled top plate structured and arranged to be coupled with the upper edge of the water permeable geotextile material.

14. The silt fence system of claim 5, wherein at least one of the posts comprises an engaging member structured and arranged to secure a portion of the geotextile material between the at least one post and the engaging member.

15. The silt fence system of claim 5, wherein the system further comprises at least one support slat that is structured and arranged to form an overlap joint at the posts to secure a portion of the geotextile material between the at least one post and the support slat.

16. The silt fence system of claim 5, wherein the system further comprises at least one ground stake driven into the ground adjacent to the lower edge of the water permeable geotextile material.

* * * * *